United States Patent [19]

Rhodes

[11] 3,998,633

[45] Dec. 21, 1976

[54] ALLOY AND METHOD FOR PRODUCING THE SAME

[76] Inventor: William A. Rhodes, 4421 N. 13th Place, Phoenix, Ariz. 85014

[22] Filed: July 10, 1975

[21] Appl. No.: 594,624

Related U.S. Application Data

[63] Continuation-in-part of Ser. No. 477,620, June 10, 1974, abandoned.

[52] U.S. Cl. ..... 75/162
[51] Int. Cl.[2] ..... C22C 9/01
[58] Field of Search ..... 75/162

[56] References Cited

UNITED STATES PATENTS

| | | | |
|---|---|---|---|
| 1,960,740 | 5/1934 | Gray | 75/153 |
| 3,091,527 | 5/1963 | Pollock | 75/162 |

*Primary Examiner*—W. Stallard

[57] ABSTRACT

An alloy having the appearance and many desirable characteristics of gold; the alloy comprising copper, aluminum and indium; the disclosure also including methods for producing said alloy as well as various finishing treatments of castings produced from said alloy.

4 Claims, No Drawings

ALLOY AND METHOD FOR PRODUCING THE SAME

This application is a continuation-in-part of Ser. No. 477,620, filed June 10, 1974, and now abandoned.

BACKGROUND OF THE INVENTION

Utilization of aluminum bronzes as a gold substitute has never become widespread in the ornamental and jewelry industry or in related products because of the difficulties of casting such bronzes due to the tendency of such alloys to cast into a generally woody grain structure.

Surface treatment of such castings has previously comprised mechanical abrasion since such prior art alloys are generally immune to chemical pickling or processing fluids.

With such alloys it has been difficult to solder or fuse the various fixtures thereto.

Prior art methods utilizing such aluminum bronzes have resorted to the inclusion of varying amounts of iron, nickel, silicon, manganese, tin, zinc, tellurium, lead and other materials in these alloys in order to render them capable of being readily cast. Substantial success has been achieved with castings using some of these metals and such castings using some of these metals and such castings as applied to machinery, where wear resistence and good corosion resistence is desired.

However, the use of an aluminum bronze containing aluminum and copper with the other metals mentioned has been unsuccessful for use as a substitute of gold in jewelry, artifacts and high detailed castings due to inferior results relating to the color complexion which is caused by the presence of the various foregoing metals added to the aluminum and copper.

These metals tend to reduce the color and luster characteristics as compared to the alloys containing only copper and aluminum. However, as heretofore set forth, such alloys of copper and aluminum alone are practically impossible to control as a casting material because of the pitting and woody grain structure at the surface of such castings.

While the addition of these various metals aforementioned make casting possible and help to eliminate the woody grain structure, the resultant alloys no longer have the rich appearance of gold but rather a dull, whitish-yellow which soon develops a dark coating as with the common bronzes.

Utilizing the foregoing prior art alloys, dirty looking castings are generally produced and brazing or soldering anything thereto is difficult. Additionally, polishing and buffing is very unsatisfactory and, therefore, castings of such material when an attempt is made to substitute for a gold color leaves a great deal to be desired.

A common and well-known prior art gold substitute has been Nurnberg gold, an alloy of 90% copper, 7.5% aluminum and 2.5% gold was invoked. This alloy was rendered relatively easy to cast by utilizing 2.5% gold; however, the usual salt tests on Nurnberg gold alloy was disappointing. This Nurnberg gold substitute produced a green-black coating within eight hours when subjected to a salt test.

Additionally, various articles of jewelry such as rings, and bracelets caused a green deposit on the skin of wearers which was highly undesirable.

Additionally, some of the foregoing aluminum bronzes containing lead or iron, for example, and containing some other of the foregoing mentioned materials would produce an alloy which could be used to make dark marks on paper and, consequently, articles made of such alloys tended to rub off even in a dry state on various articles adjacent thereto. Accordingly, costume jewelry and other devices made of such prior art alloys caused marking and discoloration of the skin as well as clothing or the like.

SUMMARY OF THE INVENTION

This invention relates to an alloy of aluminum, copper and indium, copper having an aluminum content ranging from 0.5% to 7½% and indium content of 1% to 5% and the remaining being copper.

My invention also includes a technique for making the foregoing alloy.

Additionally, the method for producing the alloy includes the use of phosphorus in the molten copper whereby the indium and the aluminum readily alloy with the copper with a minimum of oxidation and attendant problems. The alloy of the invention has many desirable characteristics of 14 to 18 carat gold, paricularly as the alloy relates to costume jewelry, belt buckles and other items which may be worn on a person's hands or clothing.

The alloy of the invention is very malleable and subject to various forming operations and it is also readily receptive to fusion of various articles thereto by means of conventional lead and tin alloy solders as well as other solders such as silver solder or conventional brazing alloys. The alloy of the invention is very resistent to corrosion under normal environmental conditions in which the alloy is in contact with human skin. Additionally, the alloy does not readily make dark marks on articles on which it is rubbed as, for example, the alloy does not readily tend to make black marks on paper when rubbed thereagainst and, consequently, articles such as belt buckles which are made of the alloy of the invention do not tend to make undesirable marks on clothing as, for example. Additionally, the cost of the materials to produce an attractive gold substitute in accordance with the present invention are very reasonably priced and the alloy of the invention has an appearance which so resembles 14 to 18 carat gold that it is almost impossible to recognize as a substitute.

Accordingly, it is an object of the present invention to provide an alloy having nobility similar to 14 carat gold specifically with regard to the usual environmental conditions as may apply to the handling and wearing of the alloy on a person's hands and also with relation to general atmospheric conditions under which the alloy may be worn in the form of rings, bracelets, etc.

Another object of the invention is to provide an alloy having almost identical appearance to gold and which is comparable in tarnish resistence to 14 carat gold alloys when subjected to the usual salt corrosion tests.

Another object is to provide an alloy which is substantially unaffected by oxidizing conditions of a torch or furnace and which may be cast into open molds with no adverse affect on the surface color of the alloy.

Another object of the invention is to produce an alloy which has ductility equal to conventional 14 carat gold alloys.

Another object of the invention is to produce an alloy which is substantially equivalent to 14 carat gold or sterling silver in its ability to be sawed, ground, cast, tumbled, pickled, polished and which is also readily fusible with soft and hard solders with or without silver or gold therein.

Another object of the invention is to provide an alloy having tarnish resistence substantially equal to 14 carat gold when under the same time and wear conditions wherein the alloy of the invention does not tarnish to any darker or greater proportion than is evident in the gradual tarnish or darkening of 14 carat gold alloys.

A further object of the invention is that the alloy of the invention after soldering may be pickled and buffed and thereby readily removing any slight surface discoloration caused by heating and such being comparable to the effects of 14 carat gold alloys when soldering or other fusion processes are accomplished thereon which causes heating thereof and resultant slight change in color.

An additional object of the invention is to provide an alloy which contains the richest rose to yellow color of the 14 to 18 carat gold alloys.

DESCRIPTION OF THE PREFERRED EMBODIMENTS

The alloy of the invention comprises aluminum and copper and these metals are of the highest purity. The alloy also comprises indium of at least 99.99 purity and these three elements are included in the alloy in the following proportions, which depends on the color and degree of tarnish resistance required and ranges from "rose" at one extreme to yellow at the other and from moderate tarnish resistance toward the rose to excellent tarnish resistance toward the yellow.

For purpose of example — if a 5% Indium content is chosen for all specimens and the aluminum is varied between say 1% and 7.5%, all intermediate colors can be thus varied from rose to yellow with resistance to tarnish being good to moderate at 1% aluminum improving toward excellent as aluminum is raised toward 7.5%.

When Indium exceeds 5% with aluminum between 5 and 7.5%, the alloy begins to leave the yellow assumes a whiter color which departs from the gold colored substitute herein. Indium or aluminum alone, i.e., one without the other, does not provide maximum tarnish resistance, such resistance depending upon addition of both metals within the aforementioned ranges to achieve such resistance.

Indium plays only a minor part in controlling color, such color change being only slightly evident between the range of 1 to 5% Indium.

Addition of aluminum beyond 7.5% produces little effect on color, however, above 8% and toward 10%, the alloy becomes difficult to cast, loses solderability, defies chemical surface treatment, becomes very dificult to buff and generally loses considerable malleability. A good range of rose colors are therefore, best attained with say 2% aluminum while Indium is varied from 1 to 5%.

The yellow range is best managed with a range of 5 to 7.5% aluminum while Indium is varied between 1 and 5%.

Assuming a 5% Indium content for the following conditions, through experiment, the lowest range of aluminum permissable is slightly above 0.25% because from that percentage downward, raw copper begins to bloom through the surface to oxidize, forming red spots of discoloration.

At zero aluminum a black surface with much scale is evident with an underlying metallic color of copper.

At 1% aluminum the casting ability is excellent with a clean rose colored surface which is matched by underlying metal. Tarnish resistance is good when compared with zero aluminum above.

A last condition where no Indium is used and aluminum of 1% is cast, again while the surface is clean, color is that of raw copper on the surface and substrate and tarnish characteristics are near that of raw copper.

The foregoing establishes the maximums and minimums of both metals with copper with the preferred percentages being in whatever above color and tarnish range desired for the particular use.

Alloys including the foregoing amounts of Indium are relatively easy to pickle in dichromate sulfuric acid solution in a few seconds whereas a binary alloy of copper and aluminum without the Indium is very difficult to pickle and clean.

The Indium also contributes to the brilliant luster and the ease with which the alloy may be buffed and polished. Also Indium contributes to the character of the alloy rendering it readily amenable with tin lead solders or low silver and gold solders.

The addition of the Indium to the copper and the aluminum causes the alloy of the invention to resemble 14 carat gold alloys in almost all noble characteristics except density and attack by strong nitric acid.

The alloy of the invention does yield to ammoniums and hydroxides at substantially the same rate as 14 carat gold alloys containing copper.

It is to be noted that the copper content of the alloy comprises the remainder of percentages of aluminum and Indium and, chosen, the alloy may be produced as follows: pure Grade "A" copper may be melted by either a reducing neutral or oxidizing flame. The neutral and oxidizing flame produces an excellent malleable casting while a reducing or carbonizing flame produces a much harder metal and is liable to likewise cause bubbles deep within the casting.

The copper is first melted then phosphorus ranging from 0.05% down to 0.025% is added to said copper for the purpose of deoxidizing it. Within a few seconds after the phosphorus is added the Indium, in the foregoing percentage, is added.

Addition of the aluminum follows. The exothermal reaction of aluminum causes a slight rise in temperature of the melt and this temperature rise may be as much as 300° F depending on the percentage used. The aluminum rod should be gradually pushed into the molten mass until it is completely melted and almost instantly an aluminum skin flashes over the surface of the entire melt rendering the molten alloy immune from further oxygenation. During the insertion of the aluminum in rod form care should be taken to feed the rod into the surface only as it melts and to avoid pushing the aluminum against the bottom of the crucible in which the melt is contained.

Too much mechanical stirring is avoided in order to prevent the possibility of gas entrainment and also to prevent the oxygenation of aluminum in the alloy. The least amount of stirring during the production of the alloy, as aforementioned, is desirable, however, any stirring should be accomplished by a carbon rod, the only material which should be used, and the carbon rod is preferably inserted into the molten alloy and stirred only with the rod in place without any in-and-out movement of the rod while moving very slowly. The rod should then be pulled straight out of the melt and after such limited stirring the melt can be kept heated for any length of time or poured into ingots.

The alloy is preferably poured into ingots and reheated before casting due to the fact that complete alloying apparently takes place when the alloy is remelted.

The melting temperature is approximately 1950° F and the preferred casting temperature is approximately 2000° F. It will be noticed that an aluminum oxide skin is evident on the tope of the cast, also an aluminun skin may or may not be present in the bottom of the crucible depending on technique and equipment. During initial casting of ingots or during remelting of the alloy after ingots have been produced, it may be noted that an oxide scum is present on the surface of the melt and it may be necessary to move the scum back slightly from the pouring spout of the crucible outlet area when centrifugal casting of the alloy is being accomplished.

It should be noted that continuous raking of the skin off the melt should be avoided so as to prevent undue lowering of the aluminum content of the alloy.

For ideal melting conditions, an induction furnace should be used which causes the alloy to stir itself adequately due to electromagnetic action of the induction field.

Accordingly, it is recommended that the induction furnace be used during the alloying as well as the preparation of the alloy for casting, however, as aforementioned, a torch flame which is either neutral or oxidizing may be used effectively.

Inasmuch as the melting temperature of the alloy is approximately 1950° F and the casting temperature is ideally about 2000° F, an optical pyrometer should be used in order to determine the proper casting temperature of the metal when it is desired to making castings in the conventional investment lost wax process, for example.

An optical pyrometer used for this purpose will have limits of error plus or minus fifty degrees from the 2000 degree temperature and it may be desirable to heat the metal of the alloy to a temperature ranging in the region of 50 to 100 degrees Centigrade above the melting point of the metal, however, temperatures above this range should be avoided in order to minimize the tendency of the metal to become damaged due to gas entrainment as the pour takes place or during the casting of the metal from the crucible into a mold.

I claim:

1. An alloy comprising: copper, aluminum and Indium; the aluminum ranging between 0.5% to 7.5% by weight of the alloy and the Indium ranging between 1% and 5% by weight of the alloy; and the copper ranging in an amount to equal the remaining percentage by weight of the alloy weighing 100%.

2. An alloy method comprising: the alloying of copper, aluminum and Indium comprising aluminum ranging between 0.5% to 7.5% by weight of the alloy and the Indium ranging between 1% and 5% by weight of the alloy and the copper ranging in an amount equal to the remaining percentage by weight of the alloy weighing 100%; wherein the method comprises first heating the copper to a molten state and adding the Indium and the aluminum to the molten copper.

3. The invention as defined in claim 2, wherein: phosphorus rich copper is first added to the molten copper then Indium is added to the molten copper and then aluminum is added to the copper and Indium melt until the aluminum is melted into the molten copper and Indium.

4. The invention as defined in claim 3, wherein: the Indium is first added to the melt and then the phosphorus rich copper is added to the melt and thereafter causes a deoxidizing action in the melt for substantially thirty seconds or more.

* * * * *